US005121142A

United States Patent [19]

Iwazawa et al.

[11] Patent Number: 5,121,142

[45] Date of Patent: Jun. 9, 1992

[54] RECIPROCATING COLOR PRINTING SYSTEM WITH SPECIFIED POSITIONING OF PRINTING HEADS RELATIVE TO A PRINTING SHEET

[75] Inventors: Toshiyuki Iwazawa, Tokyo; Masayoshi Miura, Kawasaki, both of Japan

[73] Assignee: Matsushita Electric Industrial Co., Ltd., Japan

[21] Appl. No.: 746,082

[22] Filed: Aug. 12, 1991

Related U.S. Application Data

[63] Continuation of Ser. No. 551,537, Jul. 12, 1990.

[30] Foreign Application Priority Data

Jul. 13, 1989 [JP] Japan ..... 1-181042

[51] Int. Cl.[5] ..... B41J 2/145

[52] U.S. Cl. ..... 346/140 R; 346/75

[58] Field of Search ..... 346/140 R, 1.1, 75; 400/126

[56] References Cited

U.S. PATENT DOCUMENTS 4,063,254 12/1977 Fox et al. ..... 346/75
4,198,642 4/1980 Gamblin ..... 346/75
4,232,324 11/1980 Tsao ..... 346/75
4,622,560 11/1986 Withoos et al. ..... 346/1.1

FOREIGN PATENT DOCUMENTS 64-75255 3/1989 Japan .

*Primary Examiner*—Benjamin R. Fuller
*Assistant Examiner*—Victor DeVito
*Attorney, Agent, or Firm*—Lowe, Price, LeBlanc & Becker

[57] ABSTRACT

A color printing system for color-printing images or characters on a surface of a writing sheet. The color printing system includes a plurality of printing heads which are successively arranged in parallel to each other and a feeding device for moving the writing sheet in a direction perpendicular to the head-reciprocating directions. Each of the printing heads linearly reciprocates so as to go and return in directions along the surface of the writing sheet for the color printing and has a plurality of ink-discharging nozzles. The plurality of ink-discharging nozzles are successively arranged with a pitch which is equal to or greater than twice the pitch of the finally printed lines so as to write the images or characters on the writing sheet. The feeding device moves the writing sheet in a direction perpendicular to the head-reciprocating directions by predetermined distances. After the printing heads perform the going-direction printing operation, the feeding device moves the writing sheet by a distance cooresponding to M times the line-printing pitch where M is a predetermined number, and after the printing heads perform the returning-direction printing operation the feeding device moves the writing sheet by 2N - M times the line-printing pitch, where N is the number of the ink-discharging nozzles.

3 Claims, 10 Drawing Sheets

RECIPROCATING COLOR PRINTING SYSTEM WITH SPECIFIED POSITIONING OF PRINTING HEADS RELATIVE TO A PRINTING SHEET

This application is a continuation of application Ser. No. 07/551,537 filed Jul. 12, 1990.

BACKGROUND OF THE INVENTION

The present invention relates to a reciprocating color printer such as a plane-scanning type color printer.

Recently, plane-scanning color printers have been described for use as printers having a printing head for printing an image or character on a recording sheet by reciprocation, as exemplified by description in the Japanese Patent Provisional Publication No. 64-75255. Conventional plane-scanning type color printing systems will briefly be described hereinbelow with reference to FIGS. 1 to 3. In FIG. 1, the plane-scanning type color printer is equipped with four printing heads (yellow, magenta, cyan and black printing heads) illustrated at characters A to D, each of which has N ink-discharging nozzles and is arranged to be mounted on an appropriate carriage, not shown, so as to allow reciprocation. A recording sheet illustrated at character P is fed in a direction indicated by an arrow Y and the printing heads A to D are movable in directions (going and returning directions) indicated by an arrow X which is perpendicular to the direction Y. Each printing head discharges ink in accordance with the movement in the going direction, i.e., from the left side to the right side in the illustration, so as to color-print N lines as illustrated in FIG. 2. In response to completion of the N-line color printing, the recording sheet is fed by an amount corresponding to the N lines for the returning-direction color printing. Thereafter, the printing head similarly discharges ink in accordance with the movement in the returning direction, i.e., from the right side to the left side in the illustration, so as to color-print N .lines as illustrated in FIG. 2.

In FIG. 3, another conventional plane-scanning type color printer is similarly equipped with printing heads A to D each of which has N ink-discharging nozzles which are successively arranged at a predetermined interval which is twice the line-printing pitch (half density), where the term "line-printing pitch" refers to the pitch or distance between, of lines to be finally printed by the printing heads for printing images or characters on a surface of a writing sheet. When moving in the going direction, i.e., from the left side to the right side in the illustration, each printing head performs the color-printing at the location of every other line to be printed, i.e., prints at half density, so as to print N (first to Nth) lines. That is, the first to Nth lines are printed by the first to Nth ink-discharging nozzles of the printing head so as to leave a separation for printing one line therebetween. In response to completion of the going-direction printing, the recording sheet P is moved by a distance corresponding to one print line and the printing head moves in the returning direction so as to newly color-print N additional lines between the first to Nth lines formed by the going-direction printing due to the same printing head.

There is a problem which arises with the former, however, in that a considerable tone difference occurs between the going-direction printing and the returning-direction printing because the order of overlapping inks in the going-direction printing is reversed with respect to the order of overlapping inks in the returning-direction printing. On the other hand, in the case of the latter, the tone difference problem is substantially resolved because the going-direction printing and the returning-direction printing are alternately performed on every other line, whereas, because the print lines due to the same ink-discharging nozzle are in close relation to each other, the difference of the ink-discharging amount between the nozzles greatly affects the printing quality.

SUMMARY OF THE INVENTION

It is therefore an object of the present invention to provide a color printer which is capable of improving the printing quality concurrently with eliminating the tone difference between the going-direction printing and the returning-direction printing.

In accordance with the present invention, there is provided a color printing system for color-printing images or characters on a surface of a writing sheet, the color printing system comprising: a plurality of printing heads which are successively arranged in parallel to each other and each of which linearly reciprocates bidirectionally so as to go in a head-going direction and return in a head-returning direction along the surface of the writing sheet for the color printing, each of the plurality of printing heads having a plurality of ink-discharging nozzles facing the surface of the writing sheet, the plurality of ink-discharging nozzles being successively arranged with a pitch which is equal to or greater than twice the pitch of lines to be finally printed by the plurality of printing heads so as to write the images or characters on the surface of the writing sheet; and writing sheet feeding means for moving the writing sheet in a direction perpendicular to the head-going and head-returning directions, wherein when the printing heads and writing-sheet feeding means change performance of a printing operation from the going-direction to the returning-direction the feeding means operates to move the writing sheet by a distance corresponding to M times the pitch of the printed lines, where M is a predetermined odd number in the range of $1<M<2N-1$ and N is the number of the ink-discharging nozzles of each of the plurality of printing heads. In association with a change in performance of the printing operation from the returning-direction to the going direction, the feeding means moves the writing sheet by a distance corresponding to $2N-M$ times the line-printing pitch.

Here, it is also preferable to set the predetermined number M to be substantially equal to the number of nozzles N. In this case, when N is an odd number, M is set to be substantially equal to the number of nozzles N, and the feeding means moves the writing sheet by a distance corresponding to N times the line-printing pitch both in changing from the head going-direction printing operation to the head returning-direction printing operation and in changing from the head returning-direction printing operation to the head going-direction printing operation. Further, when N is an even number, M is chosen to equal $N+1$ or $N-1$. When M is set to $N+1$, the feeding means moves the writing sheet by a distance corresponding to $(N+1)$ times the line-printing pitch in changing from the returning-direction printing operation to the going-direction printing operation and moves the sheet by a distance corresponding to $(N-1)$ times the line-printing pitch in turning from the going direction printing operation to the returning-direction printing operation. On the other hand, when M is set to $N-1$ the feeding means moves the writing sheet by a distance corresponding to (N−1) times the line-printing pitch in changing from the returning-direction printing operation to the going-direction printing operation and moves the sheet by a distance corresponding to (N+1) times the line-printing pitch in turning from the going direction printing operation to the returning-direction printing operation.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
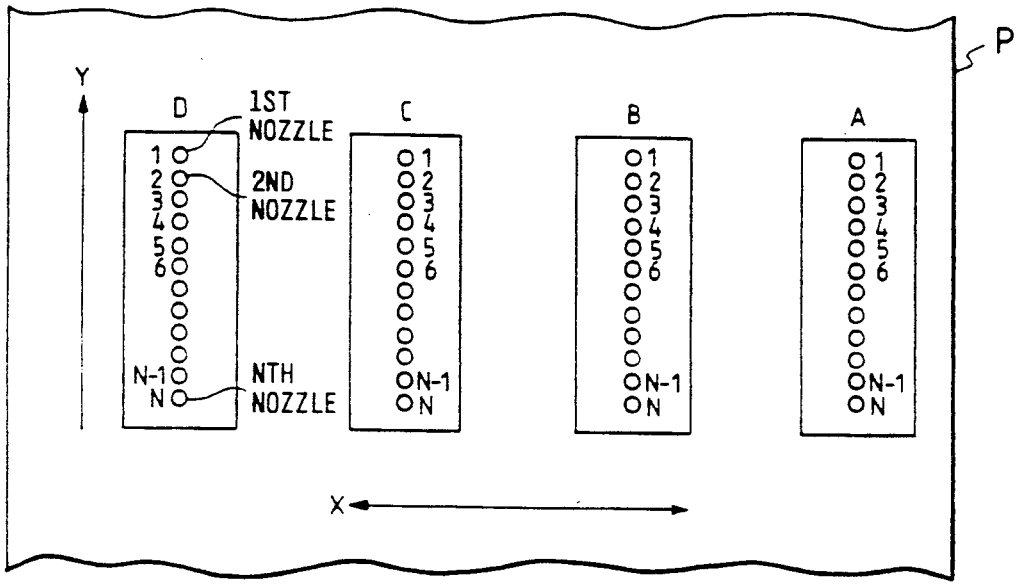
FIG. 1 PRIOR ART
FIG. 1 is an illustration for describing a printing-head arrangement of a conventional color printer.
Figure 2:
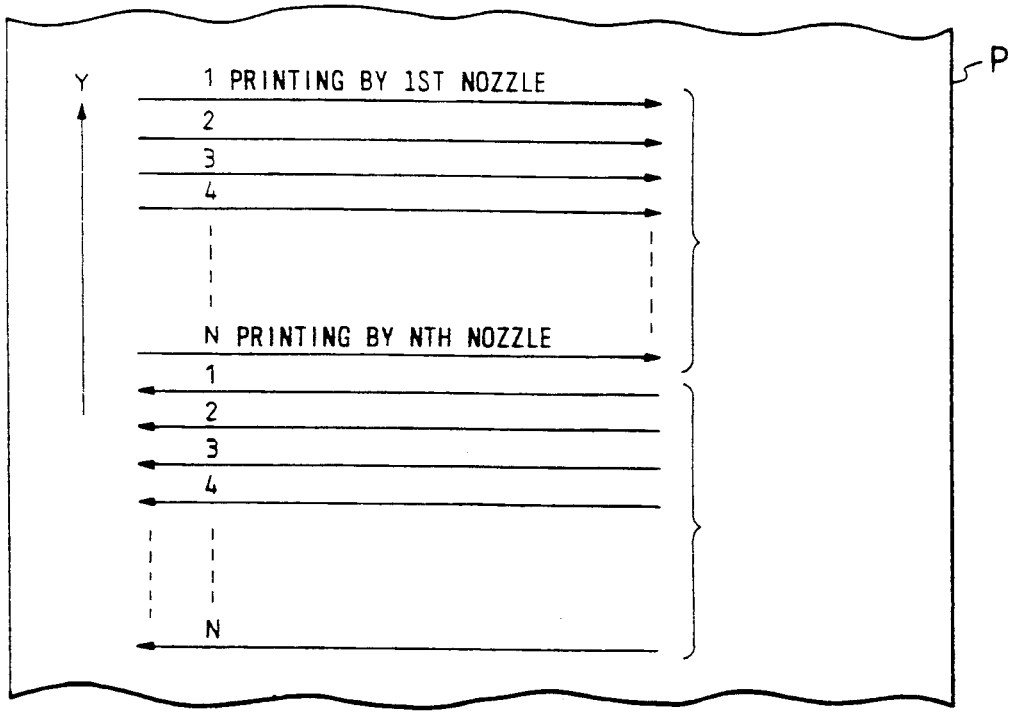
FIG. 2 PRIOR ART
FIG. 2 is an illustration for describing a first conventional reciprocating color printing system.
Figure 3:
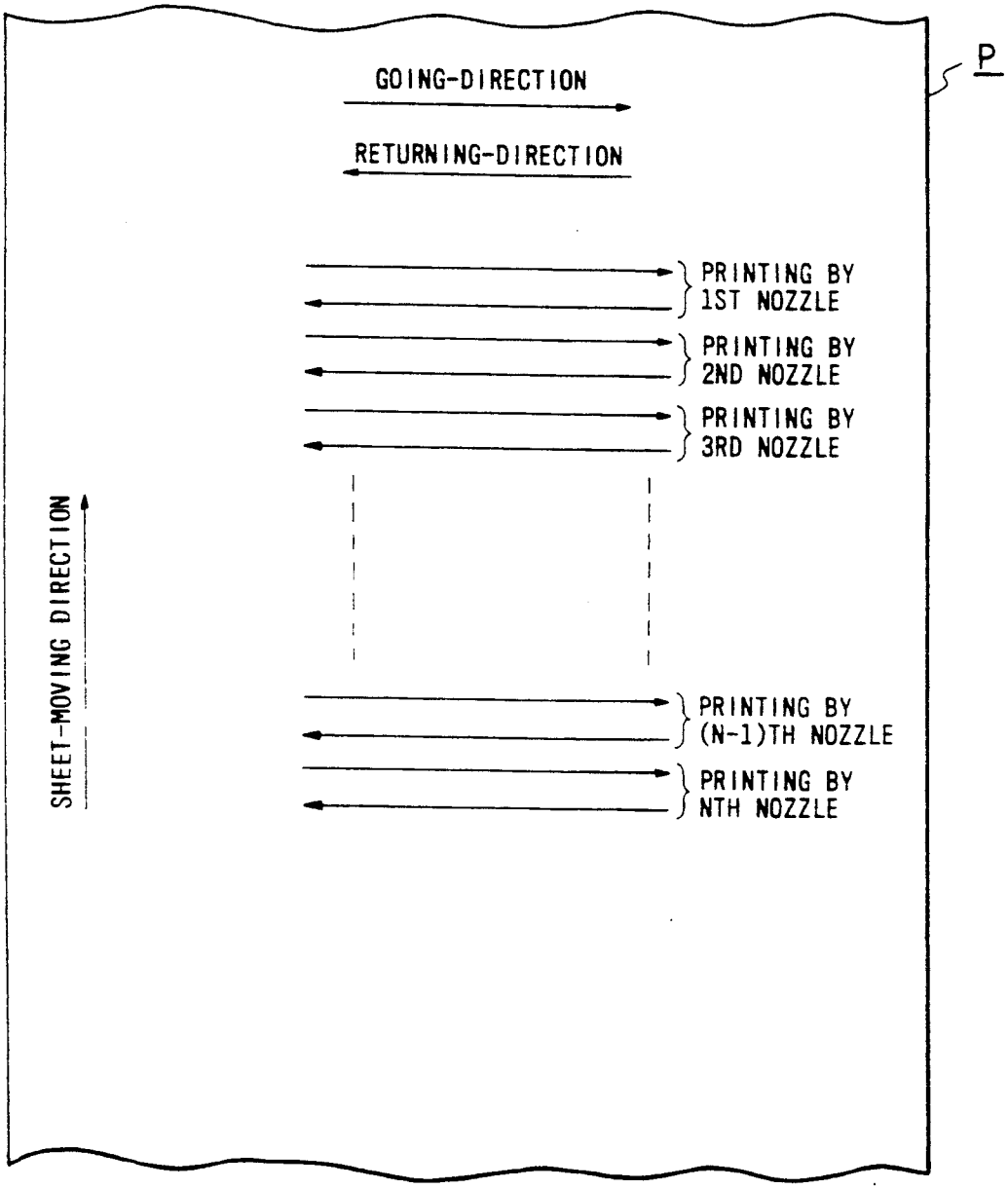
FIG. 3 PRIOR ART
FIG. 3 is an illustration for describing a second conventional reciprocating color printing system.
Figure 4:
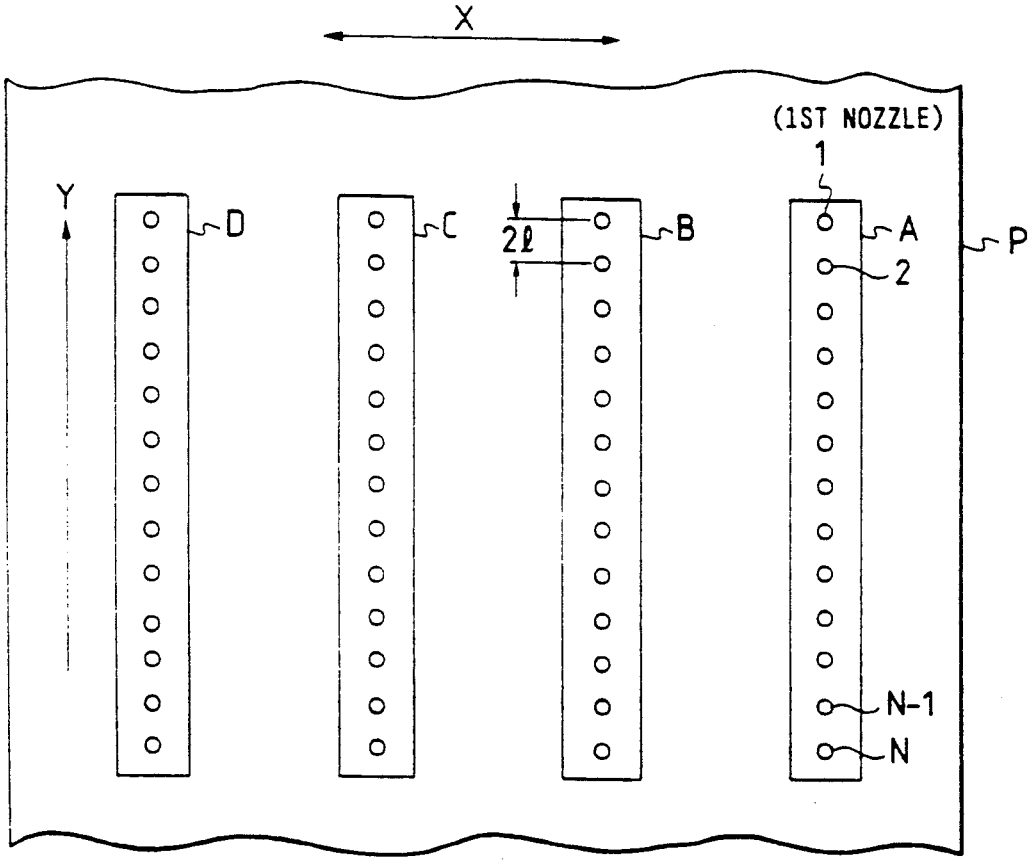
FIG. 4 shows a printing-head arrangement of a reciprocating color printing system of this invention.

FIG. 4 is an illustration for describing a reciprocating color printing system according to an embodiment of the present invention. In FIG. 4, the color printing system is provided with yellow, magenta, cyan and black printing heads A to D each of which is mounted on a carriage so as to be movable in directions indicated by an arrow X (horizontal directions in the illustration). Each of the printing heads A to D has N ink-discharging nozzles each of which discharges yellow, magenta, cyan or black ink toward a writing sheet by the aid of an electric field established between electrodes, for example. The writing sheet illustrated at character P is arranged to be movable in a direction indicated by an arrow Y which is perpendicular to the printing head moving directions X.

If the number of printing lines per 1 mm (printing density) is taken as d (dots/mm), although in a conventional color printing system the interval between the ink-discharging nozzles is l (=1/d) which is equal to the line-printing pitch, according to the color printing system of this embodiment, the interval between adjacent ones of the first to Nth ink-discharging nozzles is set to be 2 l (=2/d) which is twice the line-printing pitch. That is, each of the N ink-discharging nozzles of each of the printing heads A to D are successively arranged at an interval of 2 l in directions perpendicular to the head-moving directions X. Here, it is also appropriate to use a printing head arrangement in which the printing density is set to be d, the distance between the nozzles is set to be greater than 2/d and the axes of the printing heads are arranged to be inclined with respect to the printing head moving directions so that the distance between the nozzles in the direction Y becomes 2/d, that is, the line pitch becomes 2 l. That is, such a printing head arrangement can be employed for this embodiment under the condition that the inclination of each of the printing heads is adapted to be changeable so that the printing density for dots printed in each of the going- and returning-direction printing operations is d/2.

Figure 5:
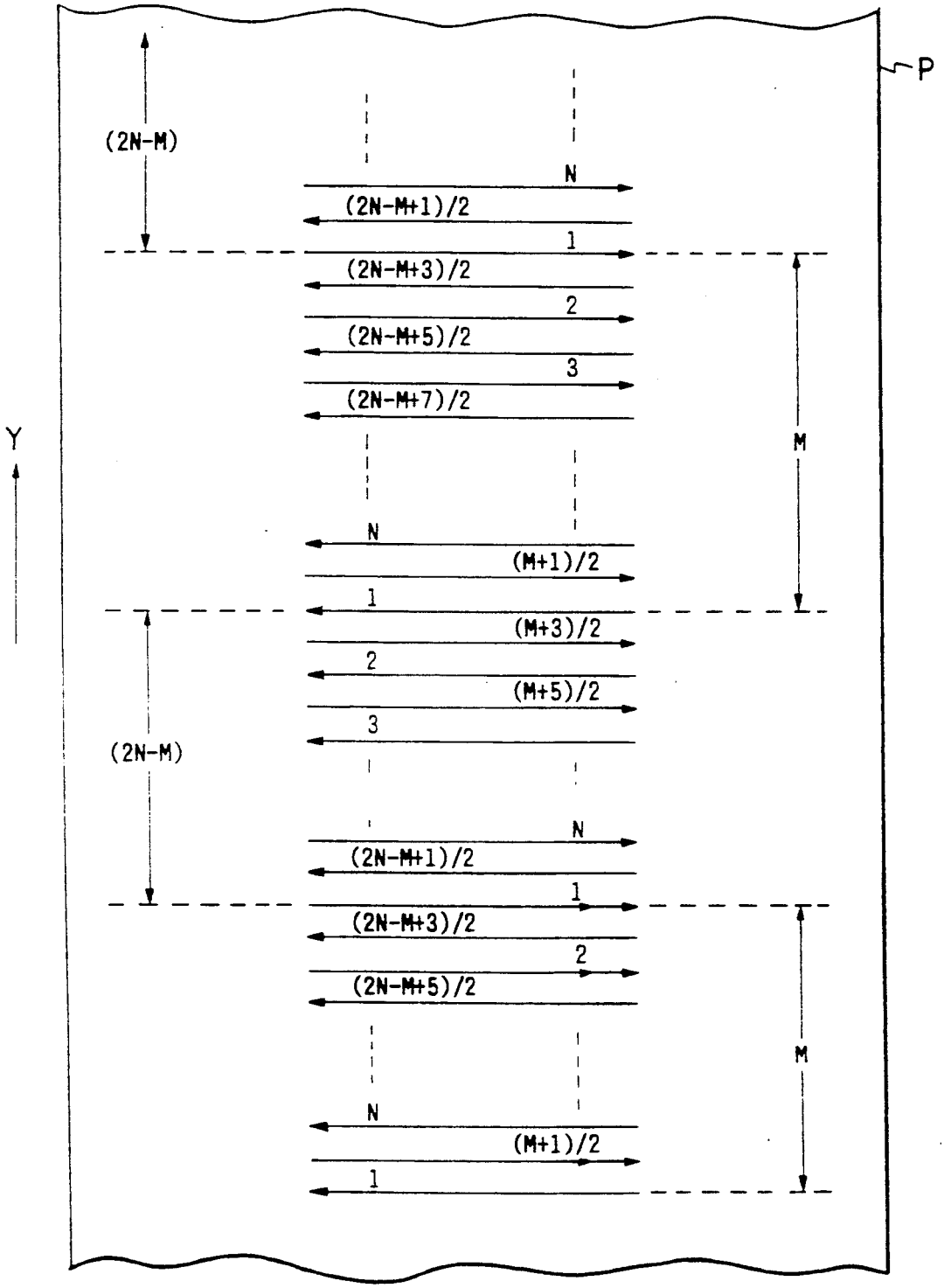
FIG. 5 is an illustration for describing a reciprocating color printing system according to a first embodiment of this invention.

A description will be made h in terms of the ink-discharging operation of the printing heads A to D illustrated in FIG. 4. Here, the printing heads A to D move from the left side to the right side in the illustration in the going-direction printing operation and, on the other hand, move from the right side to the left side in the returning-direction printing operation. In the going-direction printing operation, the first to Nth ink-discharging nozzles (illustrated at 1 to N in the FIGURE) of each of the printing heads A to D print first to Nth color lines on every other line (with a separation for one print line therebetween) as illustrated in FIG. 5, and in shifting from the going-direction printing operation to the returning-direction printing operation, the writing sheet P is moved in the direction Y by a predetermined amount which corresponds to M times the line-printing pitch ($1<M<2N-1$ and M=an odd number) and then the same printing head moves toward the left side so that the first to Nth ink-discharging nozzles thereof newly print first to Nth color lines on every other line. In the returning-direction printing operation, the first color print line formed by the first ink-discharging nozzle 1 thereof is positioned between the print lines printed in the going-direction printing operation by to the [(M+1)/2]th ink-discharging nozzle and the [(M+3)/2]th ink-discharging nozzles. Even if the value of M is taken to be 3 which is a minimum value, (M+1)/2 becomes 2. Thus, the print lines formed by the same ink-discharging nozzle are arranged so as not to be adjacent to each other.

In response to completion of the returning-direction printing operation, the recording sheet is moved by a distance corresponding to (2N−M) times the line-printing pitch so that the printing head again performs the going-direction printing operation for the first to Nth lines which are successively arranged in parallel to each other on every other line. In this going-direction printing operation, the first ink-discharging nozzle 1 of the printing head is positioned between the print lines formed in the return-direction printing operation by the [(2N−M+1)/2]th ink-discharging nozzle and the [(2N−M+3)/2]th nozzle. Thereafter, the printing head similarly performs the returning-direction printing operation. As a result, the print lines formed by the same ink-discharging nozzle are not adjacent to each other, thereby providing a high-quality color print.

A second embodiment of this invention will be described hereinbelow with reference to FIGS. 6, 10 and 11. In a plane-scanning type color printing system of this embodiment, in shifting from the going-direction printing operation to the returning-direction printing operation, the moved distance of the recording sheet P is set to M times of the print line pitch (M is an odd number and determined to be substantially equal to N). In the case of performing the going and returning-direction printing operation, it is generally required to store discharge control signals (print signal) in an appropriate line buffer memory, and the discharge control signals are successively taken from the line buffer memory along the forward direction in the going-direction printing operation and are successively taken therefrom along the opposite or backward direction in the returning-direction printing operation. In practice, it is preferable that the necessary capacity of the line buffer memory is as small as possible. In the case that M is substantially equal to N, not only the memory capacity can be reduced but also the print line due to the first ink-discharging nozzle becomes adjacent to the print line due to the ink-discharging nozzle disposed at the vicinity of the N/2th ink-discharging nozzle, thereby substantially removing the disadvantage resulting from the difference of the ink-discharging amounts between the nozzles.

Figure 6:
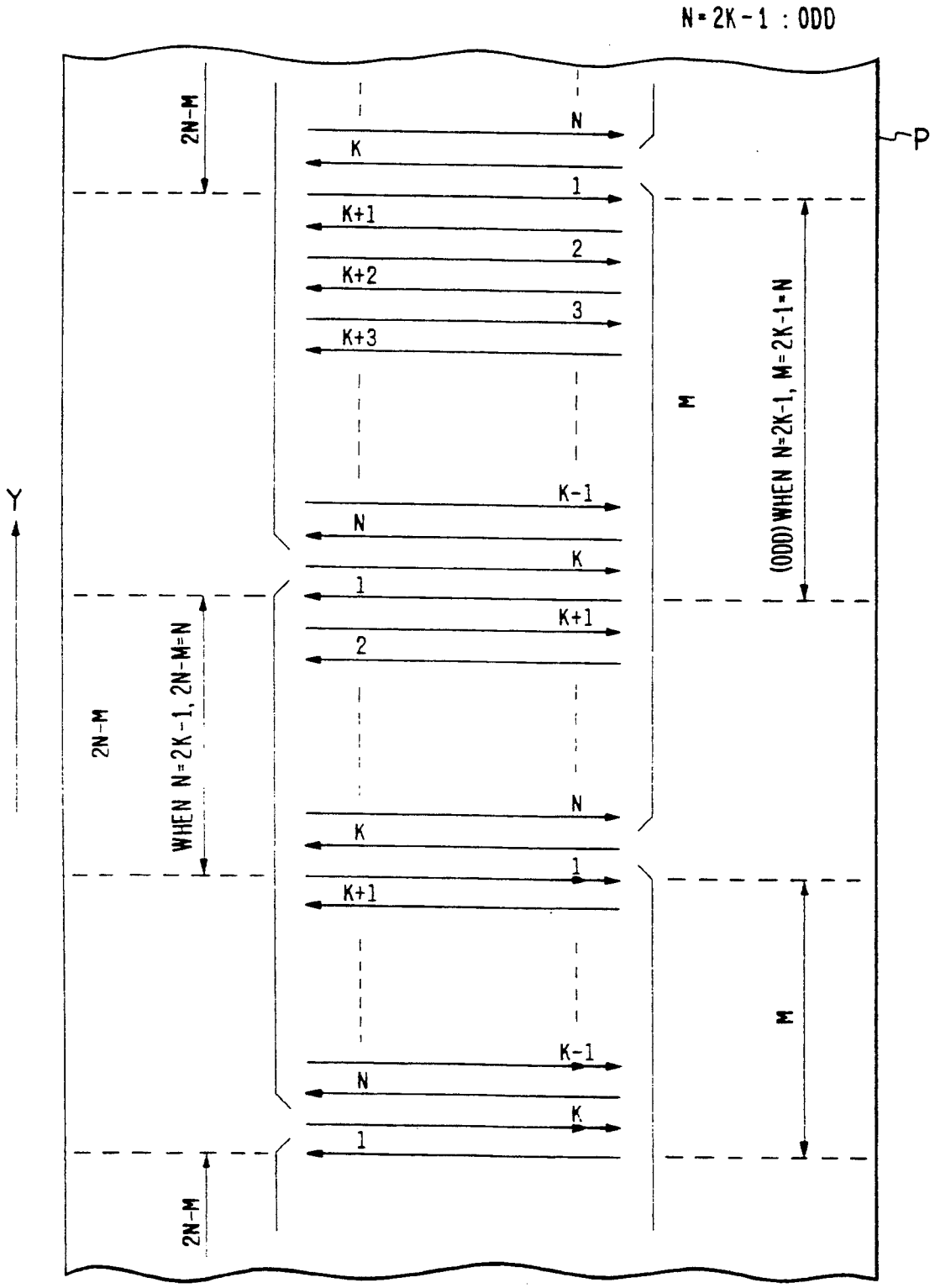
FIGS. 6 to 11 are illustrations for describing a reciprocating color printing system according to a second embodiment of this invention.
Figure 10:
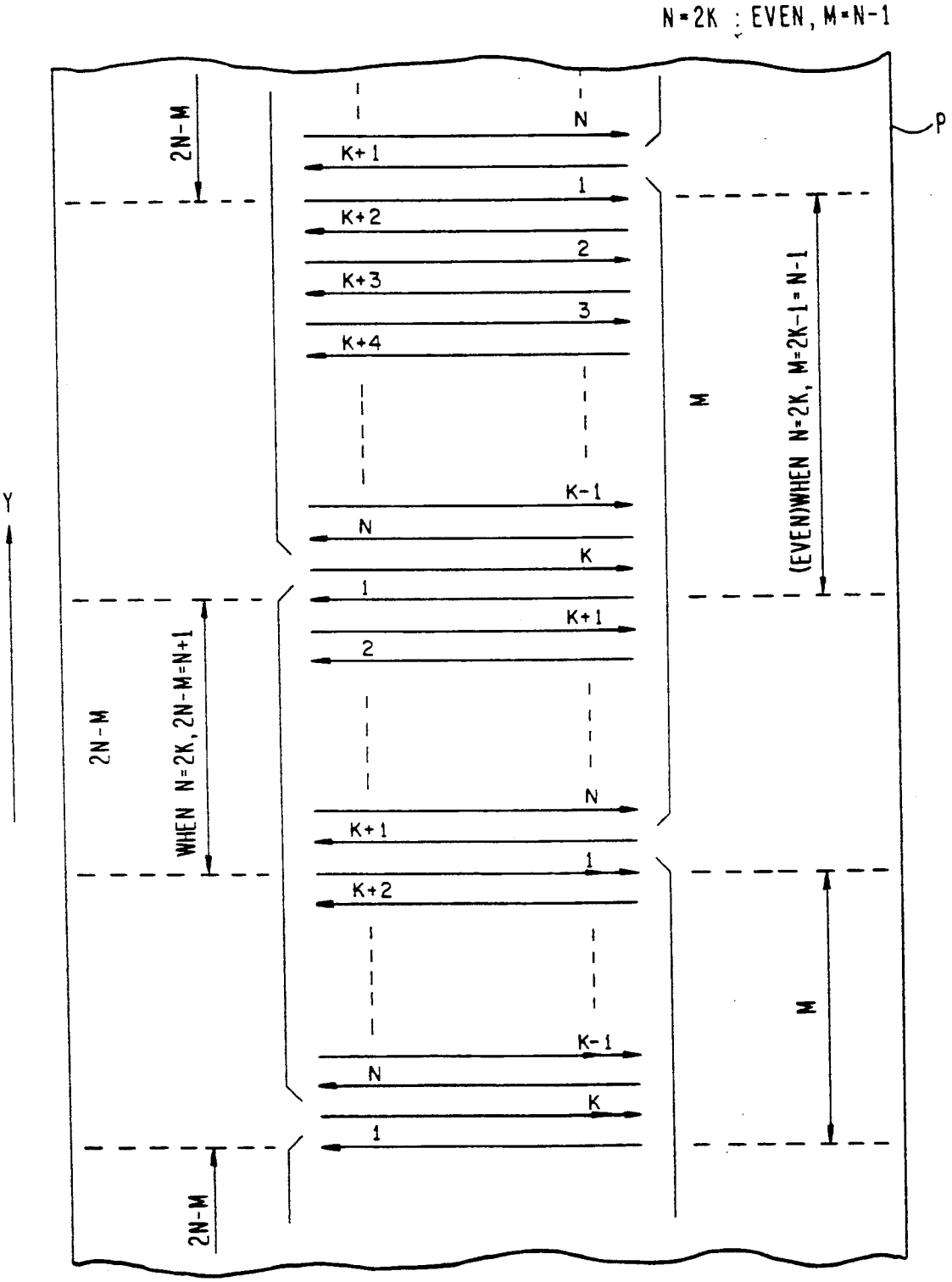
Figure 11:
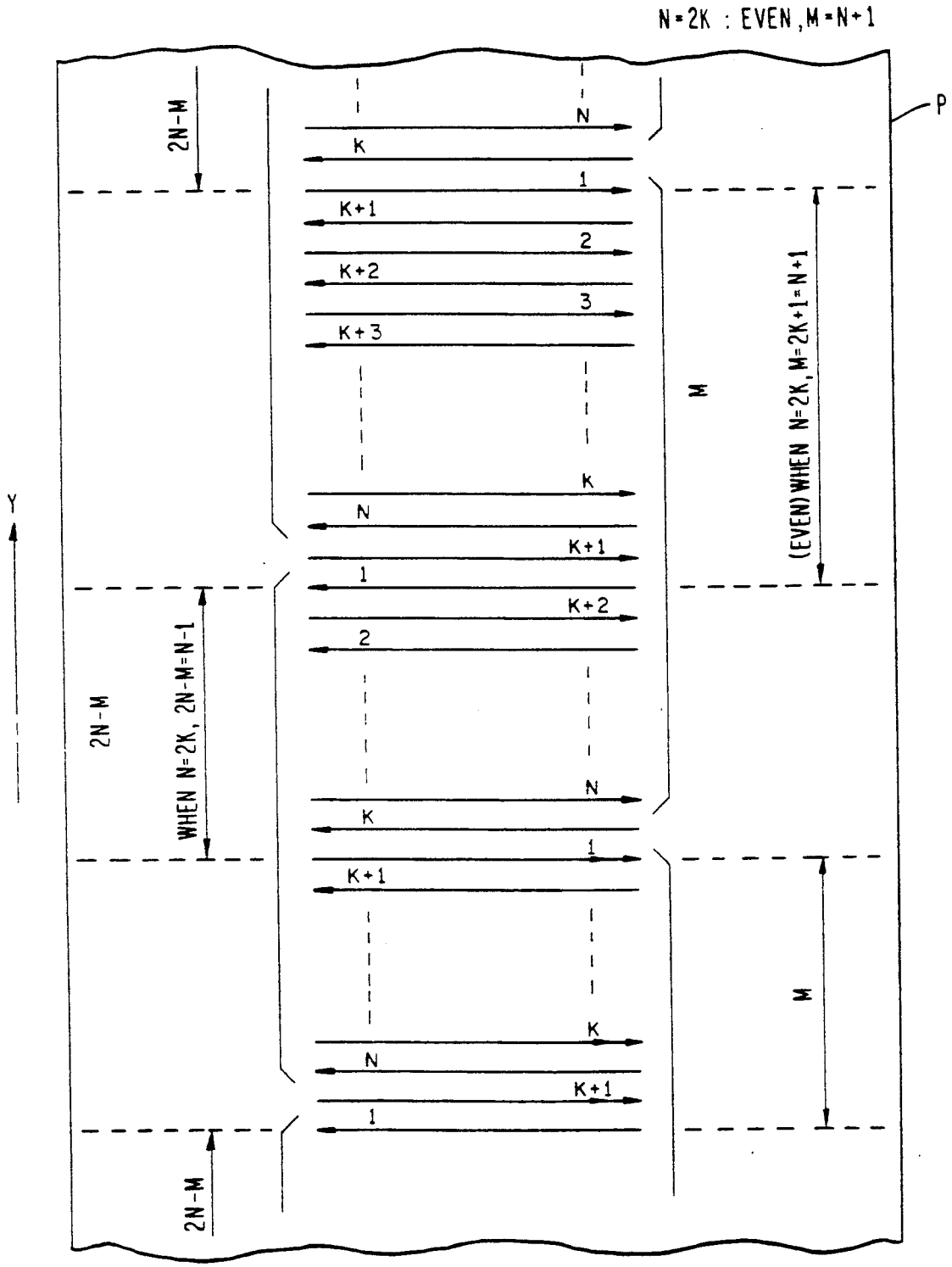

In FIGS. 6, 10 and 11, character K is a positive integer, and when N is an odd number, $N=2K-1$ $(=n)$, and when N is an even number, $N=2K$ $(=n')$. In these cases, the recording sheet P is moved by a distance which is obtained by multiplying the line-printing pitch by a value shown by the following table.

| Nozzle Number N | Moved Amount in Changing from Returning-Direction Printing to Going-Diretion Printing | Moved Amount in Changing from Going-Direction Printing to Returning-Direction Printing |
|---|---|---|
| Odd Number | $2N - M = N$ | $M = N$ |
| $N = 2K - 1$ | $= 2K - 1$ | $= 2K - 1$ |
| $= n$ | $= n$ | $= n$ |
| Even Number | $2N - M = N + 1$ | $M = N - 1$ |
| $N = 2K$ | $= 2K + 1$ | $= 2K - 1$ |
| $= n'$ | $= n' + 1$ | $= n' - 1$ |

When N is an odd number, it will be understood by referring to the above table and to FIG. 6 that the print line adjacent to the print line provided by the first ink-discharging nozzle is the print line provided by the Kth ink-discharging nozzle, both when the operation changes from the going-direction to the returning-direction and vice versa. Further, when N is an even number, the two cases should be considered. The first case is one in which the amount of movement of the writing sheet P in changing from the going-direction printing operation to the returning-direction printing operation is $N-1$ while the amount of movement in changing from the returning-direction to the going-direction is $N+1$. The second case is one in which the amount of movement of the writing sheet P in changing from the going-direction printing operation to the returning-direction printing operation in $N+1$ while the amount of movement in changing from the returning-direction to the going-direction is $N-1$. In the first case, as clearly understood by referring to the above table and to FIG. 10, the print line adjacent to the print line provided by the first ink-discharging nozzle in the returning-direction printing operation is the print line provided by the Kth ink-discharging nozzle in the going-direction printing operation, and the print line adjacent to the print line provided by the first ink-discharging nozzle in the going-direction printing operation is the print line provided by the $(K+1)$th ink-discharging nozzle in the returning-direction printing operation. In the second case, as will be clearly understood by referring to the above table and to FIG. 11, the print line adjacent to the print line provided by the first ink-discharging nozzle in the returning-direction printing operation is the print line provided by the $(K+1)$th ink-discharging nozzle in the going-direction printing operation, while the print line adjacent to the print line provided by the first ink-discharging nozzle in the going-direction printing operation is the print line provided by the Kth ink-discharging nozzle in the returning-direction printing operation.

Moreover, as illustrated in FIG. 6, irrespective of N =an odd number or an even number, the print line adjacent to the print line due to the first ink-discharging nozzle is the print line due to the Kth ink-discharging nozzle.

Figure 7:
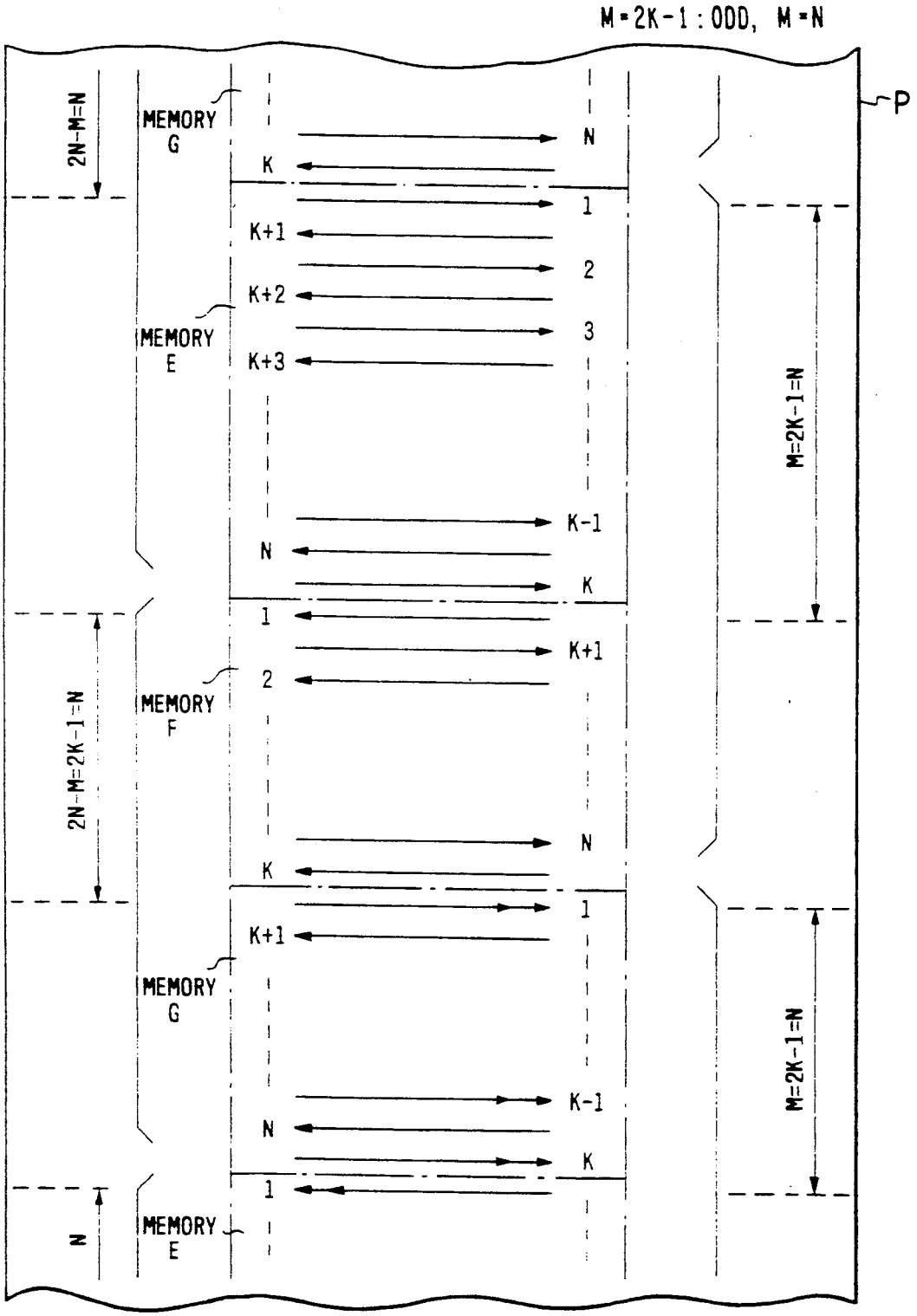

A detailed description will be made hereinbelow with reference to FIG. 7 in the case that the ink-discharging nozzle number N is an odd number $(N=2K-1=n)$. N-line buffer memories for temporarily storing the print signals at every print line can be provided so as to respectively correspond to N print lines. In the case of using such line buffer memories, the amount of each movement of the recording sheet is set to be N. Here, it is possible to use three N-line buffer memories E to G. As illustrated in FIG. 7, in the going-direction printing operation, the going-direction print signals are taken from the N-line buffer memories E and F, and at the same time the next N-line print signals are stored in the N-line buffer memory G. In response to completion of the going-direction printing operation, the recording sheet P is moved so that $M=N$ before the returning-direction print signals stored in the memories F and G are taken out along the opposite direction in order to perform the returning-direction printing operation and, at the same time, the N-line signals are inputted and stored in the memory E. Further, in response to completion of the returning-direction printing operation, the recording sheet P is similarly moved by $M=N$, before the going direction print signals stored in the memories G and E are derived along the forward direction so as to perform the going-direction printing operation and, at the same time, the next N-line print signals are inputted and stored in the memory F. With the above-mentioned operations being repeatedly performed, the color-printing can be completed. It is possible to effectively perform the reciprocation printing with the three N-line buffer memories being cyclically used.

Figure 8:
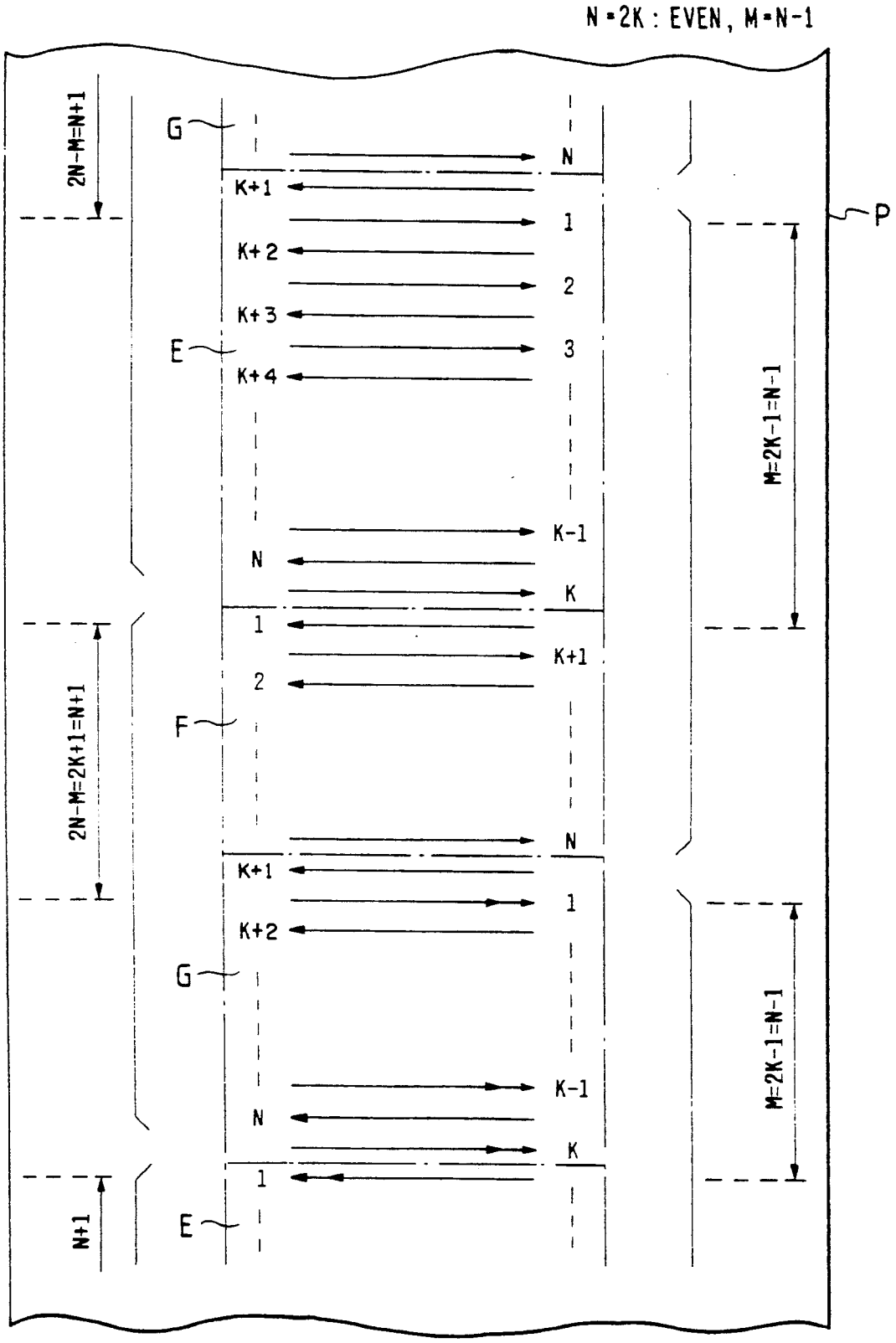
Figure 9:
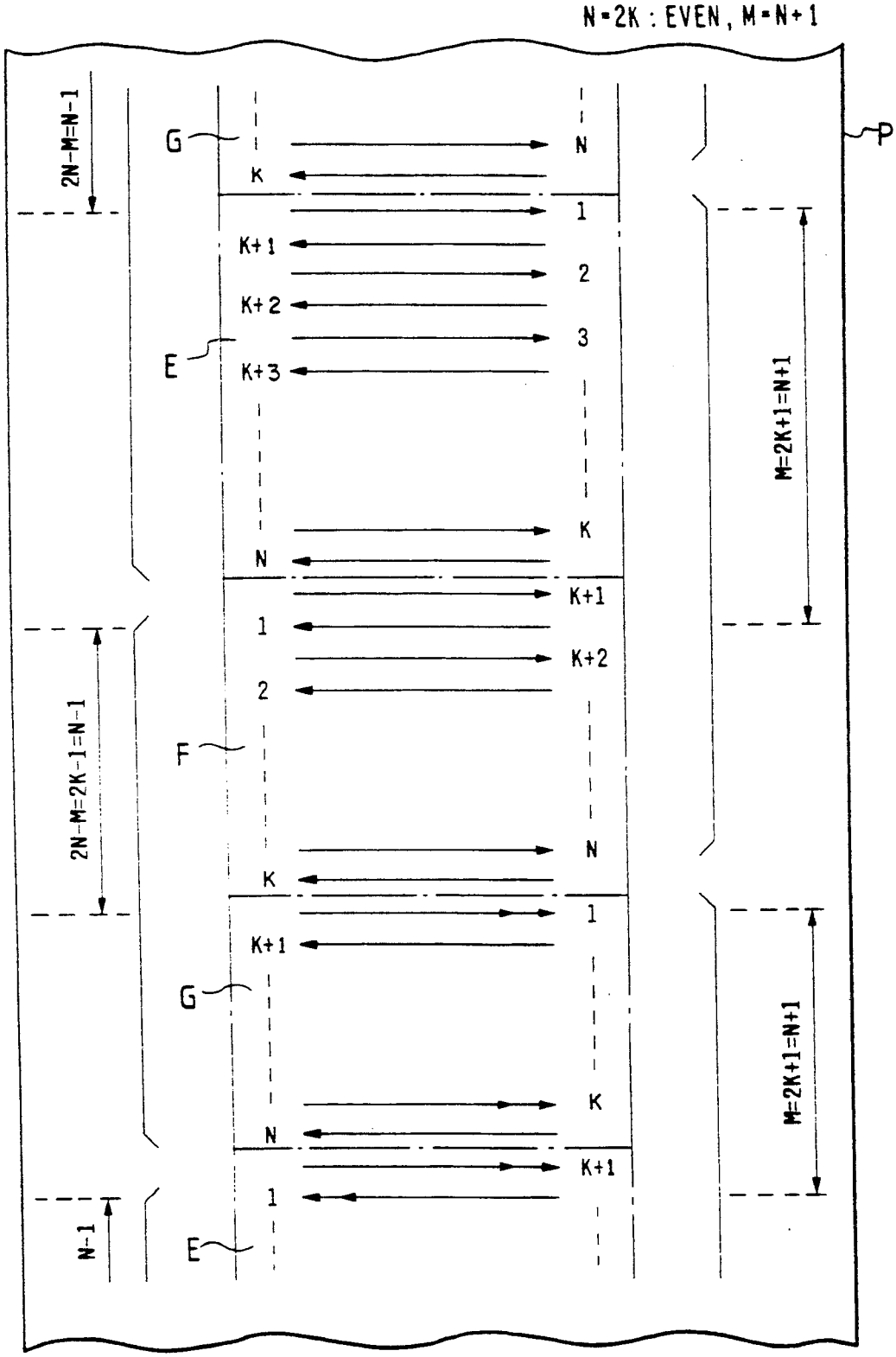

Secondly, a description will be made hereinbelow with reference to FIG. 8 in the case that the nozzle number N is an even number $(N=2K=n')$. In this case, in shifting from the going-direction printing operation to the returning-direction printing operation, the recording sheet P is moved by a feeding amount corresponding to $M=N-1$ (i.e., equal to $(N-1)$ times the line-printing pitch), and in shifting from the returning-direction printing operation to the going-direction printing operation, the recording sheet P is moved by a feeding amount corresponding to $2N-M=N+1$ (i.e., equal to $(N+1)$ times the line-printing pitch). As illustrated in FIG. 8, in the N-line buffer memories E to G, the print signals for the going-direction printing are stored in the even addresses and the print signals for the returning-direction printing are stored in the odd addresses. Here, if required, it is also appropriate for the print signals for the going-direction printing to be stored in the odd addresses and for the print signals for the returning-direction printing are stored in the even addresses. In this case, as illustrated in FIG. 9, when N is an even number, i.e., 2K, and in changing from the going-direction printing operation to the returning-direction printing operation, the recording sheet P is moved by a feeding amount corresponding to $M=2K+1=N+1$. On the other hand, in changing from the returning-direction printing operation to the going-direction printing operation, the recording sheet P is moved by a feeding amount corresponding to $2N-M=N-1$.

Thus, in the second embodiment the print line due to the ink-discharging nozzle disposed at one end of the printing head becomes adjacent to the print line due to the ink-discharging nozzle disposed at the center portion of the printing head. Therefore, it is possible not only to improve the color print quality but also to reduce the number of the line buffer memories.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A color printing system for color-printing images or characters on a surface of a writing sheet, said color printing system comprising:

a plurality of printing heads which are successively arranged in parallel to each other and each of said plurality of printing heads linearly reciprocating bidirectionally so as to go in a head-going direction and return in a head-returning direction along the surface of said writing sheet for the color printing, each of said plurality of printing heads having a plurality of ink-discharging nozzles facing the surface of said sheet, said plurality of ink-discharging nozzles being successively arranged with a pitch which is equal to or greater than twice a pitch of lines to be finally printed by said plurality of printing heads so as to write the images or characters on the surface of said writing sheet; and writing-sheet feeding means for moving said writing sheet in a direction perpendicular to the head-going and head-returning directions, wherein, in association with a change in performance of a printing operation by said plurality of printing heads and said writing-sheet feeding means from the going-direction to the returning-direction, said feeding means operates to move said writing sheet by a distance corresponding to M times the pitch of the printed lines, where M is a predetermined odd number having a range of $1<M<2N-1$ and N is the number of said ink-discharging nozzles of each of said plurality of printing heads, and, in association with a change in performance of the printing operation from the returning-direction to the going direction, said feeding means moves said writing sheet by a distance corresponding to $2N-M$ times the line-printing pitch.

2. A color printing system as claimed in claim 1, wherein the predetermined number M is set to be substantially equal to the number of nozzles N, and where N is an odd number, said feeding means moves said writing sheet by a distance corresponding to N times the line-printing pitch both in changing from the head going-direction printing operation to the head returning-direction printing operation and in changing from the head returning-direction printing operation to the head going-direction printing operation.

3. A color printing system as claimed in claim 1, wherein the predetermined number M is set to be substantially equal to the nozzle number N, and when N is an even number, said feeding means moves said writing sheet by a distance corresponding to $(N+1)$ or $(N-1)$ times the line-printing pitch in changing from the returning-direction printing operation to the going-direction printing operation and correspondingly moves said writing sheet by a distance corresponding to $(N-1)$ or $(N+1)$ times the line-printing pitch, respectively, in changing from the going-direction printing operation to the returning-direction printing operation.

* * * * *